US006867357B2

(12) United States Patent
Carter, Jr.

(10) Patent No.: US 6,867,357 B2
(45) Date of Patent: Mar. 15, 2005

(54) ENHANCED MECHANICAL ACOUSTIC SOUND GENERATION SYSTEM AND METHOD

(76) Inventor: Curtis Rex Carter, Jr., 1426 Biltmore Ct., Coppell, TX (US) 75019

( * ) Notice: Subject to any disclaimer, the term of this patent is extended or adjusted under 35 U.S.C. 154(b) by 0 days.

(21) Appl. No.: 10/792,509

(22) Filed: Mar. 2, 2004

(65) Prior Publication Data

US 2004/0226433 A1 Nov. 18, 2004

Related U.S. Application Data

(63) Continuation-in-part of application No. 10/188,612, filed on Jul. 2, 2002, now Pat. No. 6,700,047.

(51) Int. Cl.[7] ..... G10H 7/00
(52) U.S. Cl. ..... 84/603; 84/171
(58) Field of Search ..... 84/603–605, 171, 84/172, 719

(56) References Cited

U.S. PATENT DOCUMENTS

| | | | | | |
|---|---|---|---|---|---|
| 3,357,291 | A | * | 12/1967 | Carmichael | 84/267 |
| 4,448,103 | A | * | 5/1984 | Blakely et al. | 84/718 |
| 4,704,931 | A | * | 11/1987 | Nagai et al. | 84/600 |
| 4,939,969 | A | * | 7/1990 | Taguchi et al. | 84/719 |
| 5,440,072 | A | * | 8/1995 | Willis | 84/645 |
| 6,320,113 | B1 | * | 11/2001 | Griffin et al. | 84/738 |

* cited by examiner

*Primary Examiner*—Jeffrey W Donels
(74) *Attorney, Agent, or Firm*—Merle W. Richman

(57) ABSTRACT

Enhancing the sound quality of a mechanical acoustic sound generation device that has a plurality of notes that have a perceived low sound quality by digital sampling the corresponding notes of a mechanical acoustic sound generation device and playing them in conjunction with the notes of the device when a note having a lower perceived sound quality is generated by the device.

19 Claims, 4 Drawing Sheets

ENHANCED MECHANICAL ACOUSTIC SOUND GENERATION SYSTEM AND METHOD

CROSS REFERENCE TO RELATED APPLICATIONS

This invention is a continuation in part of Utility patent application Ser. No. 10/188,612, now U.S. Pat. No. 6,700,047 filed Jul. 2, 2002, and entitled "Enhanced Mechanical Acoustic Sound Generation System and Method".

BACKGROUND

1. Field of the Invention

This invention relates to enhancing the sound quality of mechanical acoustic sound generation devices, and more particularly enhancing the sound quality of mechanical acoustic musical instruments.

2. Description of Related Art

Mechanical acoustic sound generation devices, in particular, mechanical acoustic musical instruments are created to produce high quality sound. These instruments' sound quality vary, typically as a function of their size and quality of their materials, construction, and mechanisms. For example, concert grand pianos that are large, very carefully engineered, and made with the highest quality materials and mechanisms produce very high quality perceived sound. Similarly, concert cellos that are large and constructed of the finest materials produce high quality perceived sound.

Due to costs, limited raw materials, and high volumes, all acoustic sound generation devices manufactured do not produce high quality perceived sound. Some more affordable devices, available to the average consumer, have a perceived sound quality far below their expensive counterparts. An object of the present invention is to enhance the sound quality of more affordable mechanical acoustic sound generation devices while not employing the expensive materials, mechanisms, or assembly methods of superior mechanical acoustic sound generation devices.

SUMMARY OF THE INVENTION

The present invention includes a method and system for enhancing a mechanical acoustic sound generation device, the device capable of producing a first plurality of notes each note having a fundamental frequency and the system and method enhancing a second, smaller plurality of the first plurality. The system and method includes determining when a note is generated by the mechanical device. The method further includes determining whether the note is one of the second, smaller plurality of the first plurality of notes. Further, the method includes generating an acoustic representation of a corresponding note digitally sampled from a mechanical acoustic sound generation device when the determined note is one of the second, smaller plurality of the first plurality of notes.

In one embodiment the mechanical acoustic sound generation device is a mechanical acoustic musical instrument. In addition the system and method may generate an acoustic representation of a corresponding note digitally sampled from the mechanical acoustic sound generation device being enhanced when the determined note is one of the second, smaller plurality of the first plurality of notes. In the system and method the second, smaller plurality of the first plurality of notes has a fundamental frequency range from about 0 Hertz to 261 Hertz. In another embodiment, the system and method may varies the amplification of the acoustic representation of the corresponding note based on its frequency. Further the method may modify the frequency content of the acoustic representation of the corresponding note.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION

Throughout this description, the preferred embodiment and examples shown should be considered as exemplars, rather than as limitations on the present invention.

Figure 1:
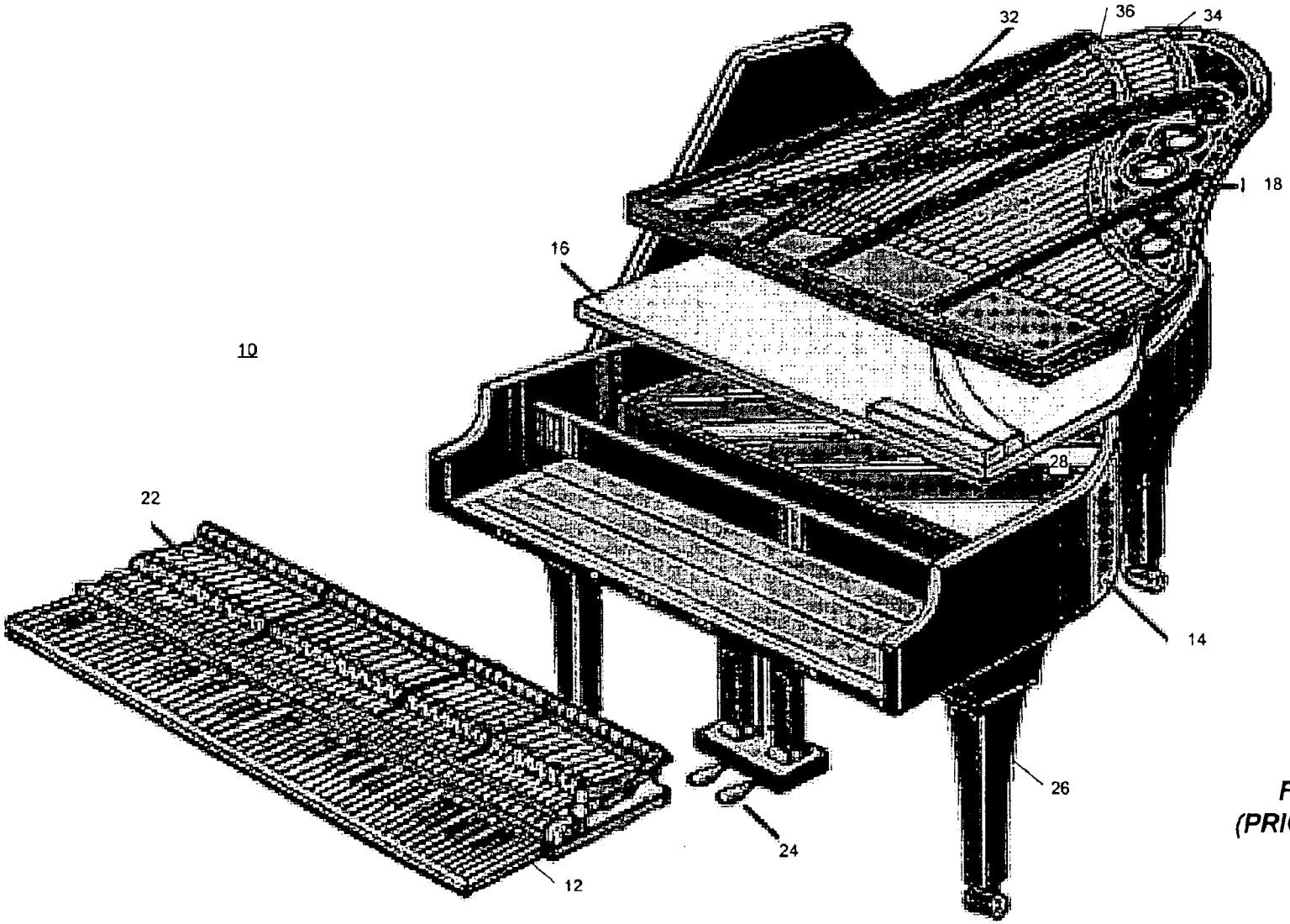
FIG. 1 (PRIOR ART)
FIG. 1 is an exploded illustration of a prior art mechanical acoustic sound generation device (concert piano).

One embodiment of the present invention is presented in reference to FIG. 1. FIG. 1 (Prior Art) is an exploded view of one mechanical acoustic sound generation device 10, in particular a concert grand piano. The mechanical acoustic device 10 is a mechanical acoustic musical instrument (piano) that generates acoustic sound. The device 10 includes a keyboard 12, case 14, soundboard 16, and frame 18. The case 14 has legs 26 and damping pedals 24. The frame 18 includes a plurality of tightly strung strings 32 divided into a bass section 32 and treble section 34. The soundboard 16 is coupled to the frame 18 via the bridge 28. The keyboard 12 includes an action 22 where the action 22 strikes string(s) 32 of the frame 18 when one or more keys of the keyboard 12 are struck and each key represents a musical note. The struck string(s) vibrate and the soundboard 16 receives the vibrations via the bridge 28 and amplifies the vibrations, producing the majority of acoustic sound/musical notes generated by the device 10. The bridge 28, frame 18, other strings (due to harmonics) 32, and case 14 also provide some of the acoustic sound generated by the device 10 when one or more keys of the keyboard 12 are struck or depressed (creating a "ching" effect).

Unless struck strings are damped, subsequent depressed keys may generate acoustic sound/musical notes that are "colored" by concurrently vibrating strings representing previous or simultaneously depressed keys (creating a "ring" effect). Also, the sound frequency spectrum generated when a string is struck varies as a function of the string length. In device 10, the piano's bass section 34 string 32 lengths and some of the treble sections 36 string 32 lengths may affect the perceived sound quality of corresponding notes generated when these strings 32 are vibrated. Smaller, usually less expensive pianos have shorter bass section 34 strings and some shorter treble section 36 strings 32 compared to large, usually more expensive concert grand pianos. For example, the bass section 34 string 32 that generates the lowest musical scale D note when vibrated is about seven feet long in larger concert grand pianos (devices 10) while generally four feet long or less in smaller, less expensive devices 10. In addition, smaller pianos tend to have smaller soundboards made of less expensive materials where the device's 10 soundboard 16 size area and material composition may also affect the device's perceived acoustic sound quality. In particular, when a smaller piano's bass key is struck, the total energy of the sound produced by the piano may be less than a corresponding key struck on a larger concert grand piano (assuming the keys are struck using the same velocity). Other mechanical acoustic sound generation devices', such as cellos, violins, guitars, sound quality may also vary as a function of size, materials, and ultimately cost.

Figure 2:
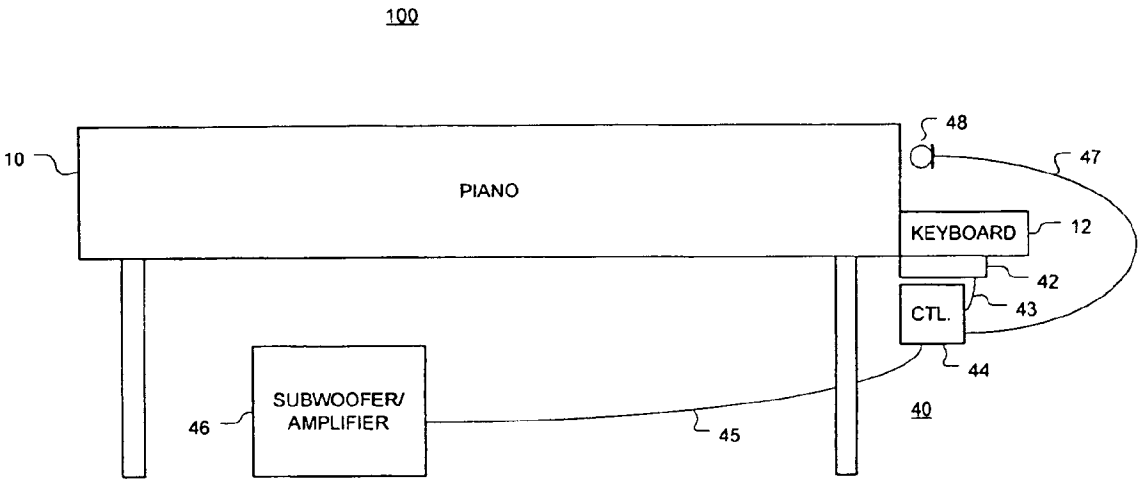
FIG. 2 is a block diagram of an enhanced mechanical acoustic sound generation device in accordance with the present invention.

FIG. 2 is a block diagram of an enhanced mechanical acoustic sound generation device 100 in accordance with the present invention. The enhanced device 100 includes a mechanical acoustic sound generation device 10 and electronic sound generation enhancement system 40. In an exemplary embodiment, the mechanical acoustic sound generation device 10 is modified to enhance its perceived sound quality where the device 10 is perceived to produce lower sound quality compared to a similar or related mechanical acoustic sound generation device, e.g., a smaller piano (baby grand, upright) modified so its perceived sound quality compares favorably to a larger, better constructed (materials and build quality), usually more expensive piano (concert grand). In particular, the electronic sound generation enhancement system 40 supplements the mechanical sound generated by the device 10 so its perceived sound quality compares more favorably with a similar device having a perceived high sound quality.

The inventor has noted that difference in perceived sound quality between high and low end devices generally varies along the frequency spectrum of the sounds generated by the devices with some spectrum sections having minimal differences and others having more significant differences (in perceived sound quality). For example high and low end pianos generally have the greatest difference in perceived sound quality at the lower end of their frequency spectrum of the sounds they generate. Further, the perceived sound quality difference decreases as the generated sound's fundamental frequency increases to where at mid or higher level frequencies (of generated sound) the difference is not detectable or insignificant. The present invention determines this characteristic and provides variable enhancement based on the differences in perceived sound quality between corresponding high and low end mechanical acoustic sound generation devices in which the invention is employed.

In one exemplary embodiment, the invention samples the sounds generated by the corresponding higher perceived sound quality device for the notes that have a detectable or significant difference in sound quality. In another exemplary embodiment, the invention samples the sounds generated by the acoustic device that is to be enhanced for the notes of the device that have a detectable or significant difference in sound quality The exemplary embodiment then regenerates these sampled sounds (from another acoustic or the acoustic device being enhanced) using a synthesizer to enhance the acoustic device when the device generates a sound in a region having a detectable or significant difference in perceived sound quality. In one embodiment a user of the enhanced device may selectably change the amplitude level or gain of these added sound signals. The user may also selectably change the frequency spectrum of the added sound signals. One exemplary enhancement system 40 for use with a piano is shown in FIG. 2 and explained with reference to FIGS. 3 to 9.

The exemplary piano enhancement system 40 includes a controller 44, an electric acoustic sound generation device 46, a microphone, and a sound/note detection system 42. In one embodiment, the sound/note detection system 42 determines when one or more notes/sounds are in the process of being generated by the device 10 and transmits this information to the controller 44 via line 43. When desirable (the perceived quality difference significant for one or more of the notes/sound being generated) the controller 44 generates an enhancement signal. The signal is transmitted to the electric acoustic sound generation device 46 via line 45 and converted to acoustic sound by the device 46 where the electrically generated acoustic sound merges with the device's 10 mechanically generated acoustic sound, improving the perceived quality of the overall produced sound. In one embodiment, the controller 44 may also sample sounds produced by the acoustic device 10 via the microphone 48 when it 44 detects a particular note has been struck (via detection system 42). In an exemplary embodiment the detection system 42 may also cause a key to be struck or actuated. In this embodiment, the controller 44 may direct the detection system 42 to actuate a key so it may then sample the acoustically generated sound via the microphone 48.

Figure 3:
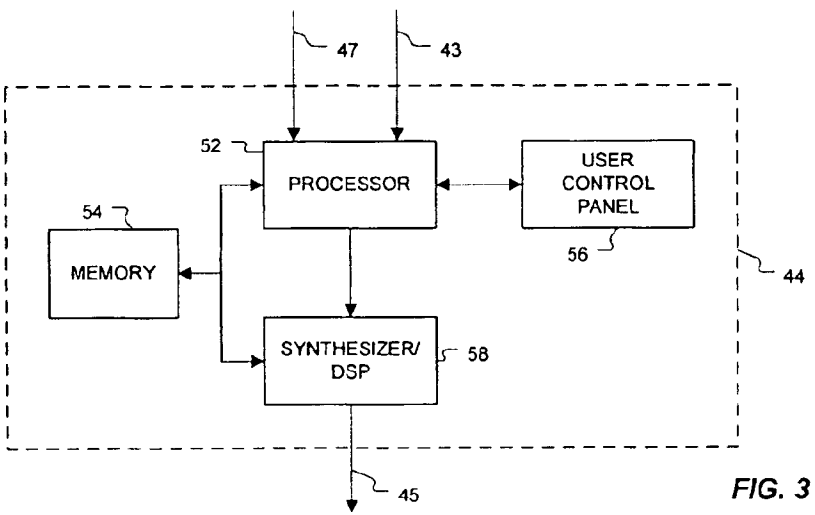
FIG. 3 is a block diagram of an exemplary electronic sound generation controller of the enhanced mechanical acoustic sound generation device shown in FIG. 2 in accordance with the present invention.

FIG. 3 is a block diagram of an exemplary controller 44 in accordance with the present invention. The controller 44 includes a main processor 52, non-violate memory 54, user control panel 56, and synthesizer/Digital Signal Process ("DSP") 58. The processor 52 may be a microprocessor or other device that can receive signals from the note detection system 42 and selections from the user control panel 56. In an exemplary embodiment, the processor 52 or other device may also sample electrical signals from the microphone 48. Exemplary use of the enhancement system 40 is presented with reference to FIGS. 4A to 9 where the device 10 is a mechanical acoustic musical instrument, in particular a piano 10. FIG. 5 is an algorithm of an exemplary process 70 of sampling the sounds generated by an acoustic source where the acoustic source may be the device to be enhanced or another similar acoustic device with similar or higher perceived sound quality.

In step 71, the process 70 determines which notes/sounds need to sampled from an the acoustic source (in one embodiment a high quality mechanical acoustic sound generation device and the device to be enhanced in another embodiment). For pianos, the inventor has noted that less expensive, smaller pianos produce low to mid frequency sounds having a perceived low sound quality with the greatest perceptible difference at the lowest frequencies and least perceptible difference at the mid to upper frequencies of sound spectrum produced by the piano 10. In one embodiment, the algorithm 70 determines the range of the device's 10 notes that need to be enhanced from its lowest note (musical scale bottom "A") to the note corresponding to the musical scale middle "C" (step 71). Then the algorithm 70 causes the acoustic source to generate the notes to be sampled (step 72), samples the notes as generated (step 74), and stores the samples for each note (step 76).

In the case of the piano 10 to be enhanced, the acoustic source is caused to generate a range of notes from its lowest note to the note corresponding to the musical scale middle "C". In one embodiment, the acoustic source is a Steinway D concert grand piano. The musical scale note middle "C" fundamental frequency is about 261 Hertz. Thus the acoustic source is caused to generate notes that have a fundamental frequency ranging from 0 to 261 Hertz. In one embodiment, each note (mechanically generated acoustic sound) is sampled (at step 74) using a digital sampling technique where the sampling rate is at least two times the fundamental frequency of the note to be sampled. In another embodiment the sampling rate is greater than two times the fundamental frequency to also samples harmonics of the generated note.

Figure 6:
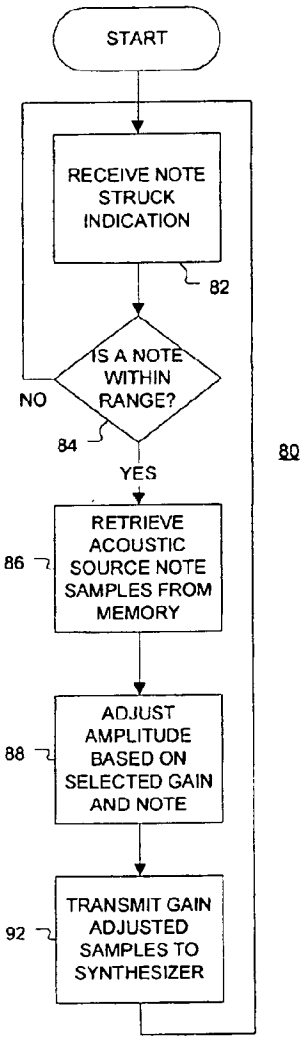
FIG. 6 is a flowchart of an exemplary electronic sound generation enhancement process in accordance with the present invention.

The digital samples representing the note produced by the acoustic source are then stored at step 76, in particular in the controller's memory 54 in the exemplary embodiment 40. Steps 72, 74 and 76 are repeated until all the notes to be generated have been sampled (step 78). In an exemplary embodiment presented in reference to FIGS. 7 and 8, the sampled sound signal may also be processed prior to storage. In particular, the frequency content of the sampled sound signal may be modified. FIG. 6 is a flowchart of an exemplary algorithm 80 for enhancing the perceived sound quality of device 10 by employing the samples generated and stored in algorithm 70. In step 82, an indication that device 10 is generating or in the process of generating one or more particular notes is received. In the enhanced device 100, the note detection system 42 is a key sensing system that determines when one or more keys of the piano's 10 keyboard 12 have been depressed or struck. Once a key is struck in a piano there is a delay (mechanical) before acoustic sound is propagated from the string to the soundboard and ultimately to a listener. An exemplary key sensing system is fully described in U.S. Pat. No. 5,001,339, which is assigned to the assignee of this invention and incorporated herein by reference. This key sensing system 42 employs opto-electronic sensors that generate a signal indicative of the displacement and the velocity of each struck, actuated, or depressed key. These signals are provided to the controller 44 via signal line 42.

In the exemplary embodiment not all notes of the device 10 are enhanced, in particular (for the piano) only notes having a fundamental frequency from 0 to about 261 Hertz are enhanced. The algorithm 84 evaluates the struck key indications to whether one or more of its corresponding notes are within the frequency spectrum of notes to be enhanced, i.e., in the piano embodiment having a fundamental frequency between 0 and 261 Hertz. In the device 100, the controller 44 scans the line 43 for struck key/notes signals and determines whether their corresponding fundamental frequency is within the frequency spectrum to be enhanced. When a note is within the enhancement frequency spectrum, the processor 52 retrieves the digital samples from the memory 54 representing the corresponding ideal source sampled note. Then the gain or energy of these samples are adjusted (step 88) based on the user selected gain (user control panel 56).

Figure 7:
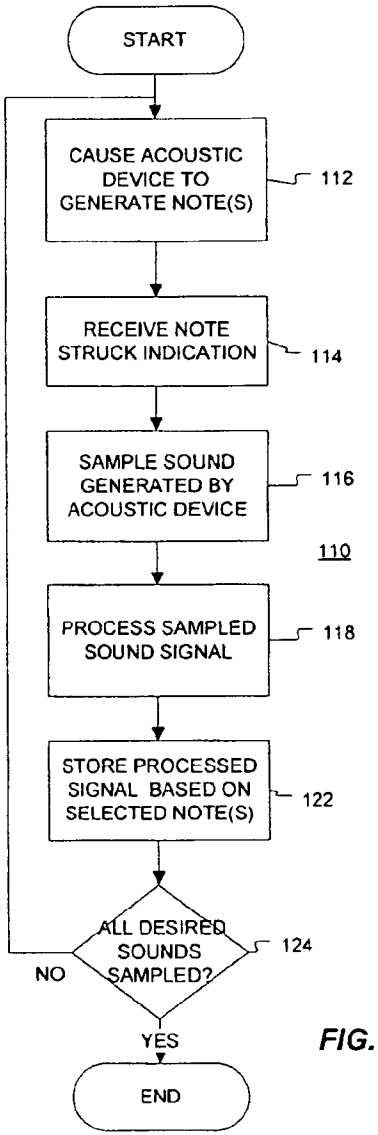
FIG. 7 is a flowchart of another exemplary process of creating sound signals to be used in an electronic sound generation enhancement process in accordance with the present invention.

FIG. 7 is an algorithm of another exemplary process 110 of sampling the sounds generated by an acoustic source where the acoustic source may be the device to be enhanced or another similar acoustic device with similar or higher perceived sound quality. Similar to the process 70 shown in FIG. 5, the process 110 causes the acoustic device generate one or more notes to be sampled (step 112). In the process 110, a note struck indication may also be received (step 114). For example, the detection system 42 may detect when a desired note has been struck. In addition, the system 42 may also cause the note to be struck in an exemplary embodiment. Accordingly steps 112 and 114 may be automated in an exemplary embodiment of the present invention. The process then samples the acoustic sound generated by the struck note and processes the sampled sound signal prior to storing the processed, sampled sound signal (steps 116, 118, and 122). Process 110 may be repeated until all desired notes/sounds have been sampled (step 124). As noted in an exemplary embodiment, the entire process 110 may be automated. In an exemplary embodiment step 118 of process 110 includes modifying the frequency spectrum of the sampled sound signal.

Figure 8:
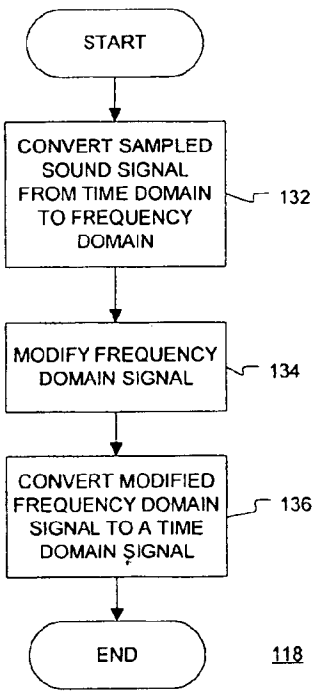
FIG. 8 is a flowchart of an exemplary process of modifying sampled acoustic sound signals, the signals to be used in an electronic sound generation enhancement process or system in accordance with the present invention.

FIG. 8 is an algorithm 118 of an exemplary process of modifying the sampled sound signal in accordance with the present invention. In this exemplary sound signal processing algorithm 118, sampled sound signals are first converted to the frequency domain (step 132). In an exemplary embodiment, the DSP 58 may employ a Fast Fourier Transform ("FFT") to convert the sampled sound signal from a time domain signal to a frequency domain signal. Then the sampled sound signal may be modified by attenuating or amplifying one or more frequency bins (step 134). A user via the controller 44 may be able to select the frequency bins to be modified and the level of attenuation or amplification of each selected frequency bin. Then the modified, frequency domain, sampled sound signals are converted to the time domain (step 136). In an exemplary embodiment, the DSP 58 may employ an Inverse FFT to convert the modified, sampled sound signal from a frequency domain signal to a time domain signal.

Figure 9:
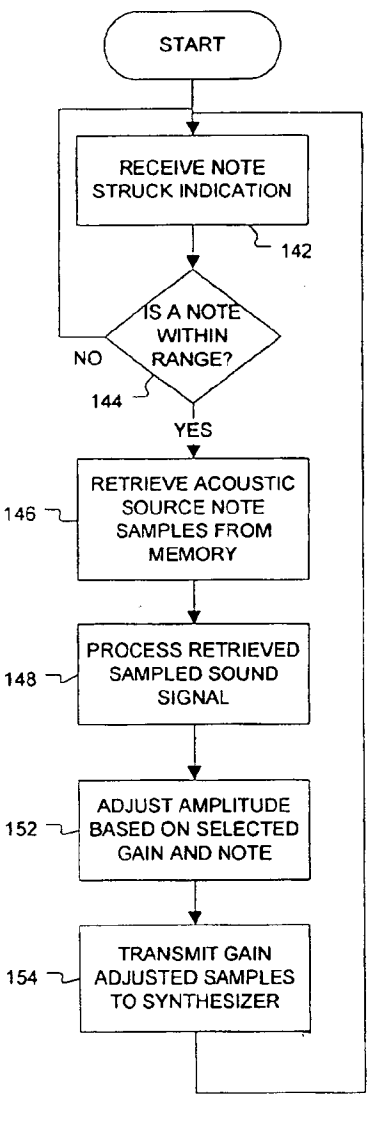
FIG. 9 is a flowchart of another exemplary electronic sound generation enhancement process in accordance with the present invention.

FIG. 9 is a flowchart of an exemplary algorithm 140 for enhancing the perceived sound quality of device 10 by employing the samples generated and stored in algorithm 70 or 110. The algorithm 140 is similar to the algorithm 80. In particular, steps 142, 144, and 146 correspond to steps 82, 84, and 86 of the process 80. Algorithm 140 includes processing the retrieved sampled sound signal at step 148 where this processing may be similar to the processing shown in FIG. 8. Steps 152, and 154 are similar to steps 88 and 92 of algorithm 80. In an exemplary embodiment the processing performed at step 148 may be different from the processing performed at step 118 of algorithm 110.

Figure 4A:
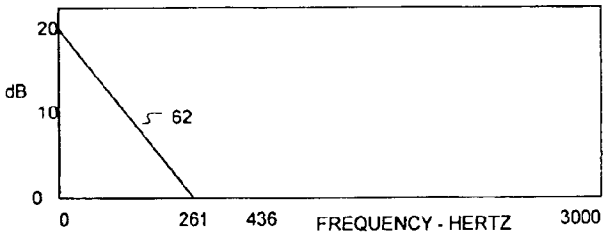
FIG. 4A is a graph of one exemplary high gain response for an enhancement signal in accordance with the present invention.
Figure 4B:
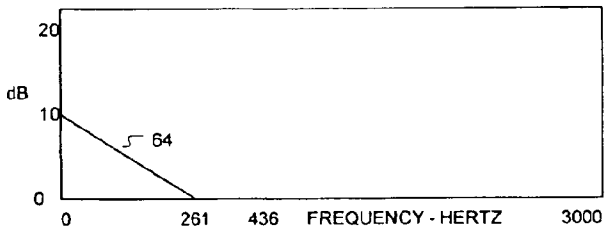
FIG. 4B is a graph of one exemplary medium gain response for an enhancement signal in accordance with the present invention.
Figure 4C:
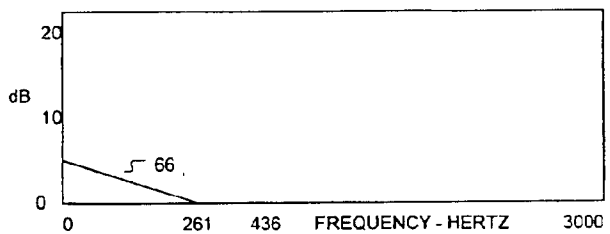
FIG. 4C is a graph of one exemplary low gain response for an enhancement signal in accordance with the present invention.
Figure 4D:
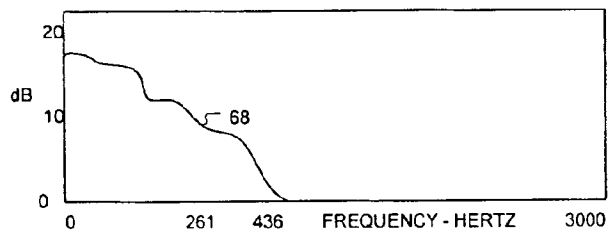
FIG. 4D is a graph of an exemplary variable gain response for an enhancement signal in accordance with the present invention.
Figure 5:
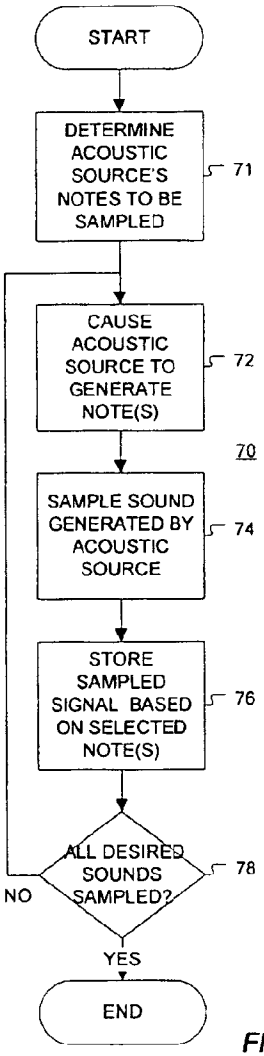
FIG. 5 is a flowchart of an exemplary process of creating sound signals to be used in an electronic sound generation enhancement process in accordance with the present invention.

FIGS. 4A to 4D are examples of various embodiments of gain according the present invention. In the embodiments shown in FIGS. 4A to 4C, the gain across the notes to be enhanced is linearly reduced (on decibel dB scale). When a user increases or lowers the gain of the enhancement, the gain adjustment applies across the range of notes to be enhanced so the gain of all notes are reduced or increased based on the linearly decreasing amplification curve. FIG. 4B, for example, illustrates a medium level gain selection for the amplification curve 64. The lowest frequency samples (when generated) have about a 10 dB gain while frequency samples (having fundamental frequency) approaching 261 Hertz have very little gain. FIG. 4A illustrates a high level gain selection for the amplification curve 62. The lowest frequency samples (when generated) have about a 20 dB gain while frequency samples (having fundamental frequency) approaching 261 Hertz have very little gain. FIG. 4C illustrates a low level gain selection for the amplification curve 66. The lowest frequency samples (when generated) have about a 5 dB gain while frequency samples (having fundamental frequency) approaching 261 Hertz have very little gain. FIG. 4D illustrates a variable amplification curve 68 where the enhancement extends to frequencies beyond 436 Hertz and is non-linear. Other amplification curves may be employed in the present invention. The gain modified samples are provided as an input to a synthesizer/DSP 58 (step 92).

The synthesizer 58 converts the samples into an analog signal. It is further amplified and converted into acoustic sound via subwoofer/amplifier 46 and cable 45. In one embodiment the synthesizer 58 is conventional, such as the synthesizer described in U.S. Pat. No. 4,953,437, which is assigned to the assignee of this invention and which is incorporated herein by reference. The subwoofer is a high quality electro-mechanical transducer, in particular a speaker that accurately reproduces lower frequency analog signals. A different frequency range speaker or a plurality of speakers having different optimal ranges may be employed depending on the frequency range of the enhancement notes to be generated.

Generally, the subwoofer speaker 46 emits sounds from both the front and rear of a cone. In one embodiment the speaker acoustic beam emitted from the cone front is oriented towards to a listener and the acoustic beam emitted from the cone rear is oriented towards to the soundboard. It is noted that using the present invention effectively lengthens the strings of piano in which is employed. For example, when the piano's 10 four foot D string is vibrated, the samples corresponding to the vibrated seven-foot long D string of a concert grand piano is produced by the synthesizer 58 and emitted from the subwoofer 46. The synthetically-produced sound of the seven-foot D string then melds with the mechanically, acoustically produced sound of the piano's 10 four-foot D string, thereby effectively lengthening the string in the acoustic piano.

While this invention has been described in terms of a best mode for achieving this invention's objectives, it will be appreciated by those skilled in the art that variations may be accomplished in view of these teachings without deviating from the spirit or scope of the present invention. For example, the present invention may be implemented using any combination of computer programming software, firmware or hardware. As a preparatory step to practicing the invention or constructing an apparatus according to the invention, the computer programming code (whether software or firmware) according to the invention will typically be stored in one or more machine readable storage mediums such as fixed (hard) drives, diskettes, optical disks, magnetic tape, semiconductor memories such as ROMs, PROMs, etc., thereby making an article of manufacture in accordance with the invention. The article of manufacture containing the computer programming code is used by either executing the code directly from the storage device, by copying the code from the storage device into another storage device such as a hard disk, RAM, etc. or by transmitting the code on a network for remote execution.

What is claimed is:

1. An enhancement system for a mechanical acoustic sound generation device, the device capable of producing a first plurality of notes each note having a fundamental frequency and the system enhancing a second, smaller plurality of the first plurality, the system comprising:

a) means for determining when a note is generated by the mechanical device;

b) means for determining whether the note is one of the second, smaller plurality of the first plurality of notes; and c) means for generating an acoustic representation of a corresponding note digitally sampled from a mechanical acoustic sound generation device when the determined note is one of the second, smaller plurality of the first plurality of notes.

2. The enhancement system of claim 1, wherein the mechanical acoustic sound generation device is a mechanical acoustic musical instrument.

3. The enhancement system of claim 1, wherein the means for generating an acoustic representation includes means for generating an acoustic representation of a corresponding note digitally sampled from the mechanical acoustic sound generation device being enhanced when the determined note is one of the second, smaller plurality of the first plurality of notes.

4. The enhancement system of claim 3, wherein the second, smaller plurality of the first plurality of notes has a fundamental frequency range from about 0 Hertz to 261 Hertz.

5. The enhancement system of claim 4, wherein the means for generating an acoustic representation of a corresponding note digitally sampled from a mechanical device varies the amplification of the acoustic representation of the corresponding note.

6. The enhancement system of claim 4, wherein the means for generating an acoustic representation of a corresponding note digitally sampled from a mechanical device modifies the frequency content of the acoustic representation of the corresponding note.

7. The enhancement system of claim 6, further comprising means for enabling a user to selectably alter the overall amplification level of the acoustic representations of the corresponding notes.

8. An enhancement system for a mechanical acoustic piano, the piano capable of producing a first plurality of notes each note having a fundamental frequency and the system enhancing a second, smaller plurality of the first plurality, the system comprising:

a) a key sensing mechanism coupled to the keyboard of the first piano;

b) a processor coupled to the key sensing mechanism, the processor determining when a key sensed by the key sensing mechanism as being depressed corresponds to a note that is one of the second, smaller plurality of the first plurality of notes;

c) a synthesizer coupled to the processor, the synthesizer generating an analog representation of a corresponding note digitally sampled from a piano when the processor indicates that a sensed key corresponds to a note that is one of the second, smaller plurality of the first plurality of notes; and d) a speaker coupled to the synthesizer to generate electro-mechanical acoustic representations of the synthesizer's analog signals.

9. The enhancement system of claim 8, further comprising a memory coupled to the synthesizer, the memory storing digital samples of notes produced by a piano.

10. The enhancement system of claim 8, wherein the sampled piano is the piano being enhanced.

11. The enhancement system of claim 8, wherein the processor varies the amplification of the acoustic representation of the corresponding note.

12. The enhancement system of claim 8, wherein the processor modifies the frequency content of the acoustic representation of the corresponding note.

13. A method of enhancing a mechanical acoustic sound generation device, the device capable of producing a first plurality of notes each note having a fundamental frequency and the method enhancing a second, smaller plurality of the first plurality, the method comprising the steps of:

a) determining when a note is generated by the mechanical device;

b) determining whether the note is one of the second, smaller plurality of the first plurality of notes; and c) generating an acoustic representation of a corresponding note digitally sampled from a mechanical acoustic sound generation device when the determined note is one of the second, smaller plurality of the first plurality of notes.

14. The method of claim 13, wherein the mechanical acoustic sound generation device is a mechanical acoustic musical instrument.

15. The method of claim 14, wherein step c) includes generating an acoustic representation of a corresponding note digitally sampled from the mechanical acoustic sound generation device being enhanced when the determined note is one of the second, smaller plurality of the first plurality of notes.

16. The method of claim 14, wherein the second, smaller plurality of the first plurality of notes has a fundamental frequency range from about 0 Hertz to 261 Hertz.

17. The method of claim 14, wherein step c) includes the step of varying the amplification of the acoustic representation of the corresponding note based on its frequency.

18. The method of claim 14, wherein step c) includes the step of modifying the frequency content of the acoustic representation of the corresponding note.

19. The method of claim 18, further comprising the step of enabling a user to selectably alter the overall amplification level of the acoustic representations of the corresponding notes.

* * * * *